United States Patent [19]

Kuboyama

[11] 4,257,199

[45] Mar. 24, 1981

[54] STADIUM COVER

[76] Inventor: Kazuo Kuboyama, Rte. 1, Box 285, Lihue, Kauai, Hi. 96766

[21] Appl. No.: 44,056

[22] Filed: May 31, 1979

[51] Int. Cl.[3] ..... E04B 1/345

[52] U.S. Cl. ..... 52/2; 52/63; 52/72; 135/5 R; 135/DIG. 8; 49/104; 49/110; 49/366

[58] Field of Search ..... 52/2, 3, 63, 64, 72, 52/80, 82; 135/1 R, 8, 5 R, DIG. 8; 49/40, 86, 104, 110, 115, 123, 324, 371, 366

[56] References Cited

U.S. PATENT DOCUMENTS

| | | | |
|---|---|---|---|
| 1,651,391 | 12/1927 | Holysz | 49/104 |
| 2,000,515 | 5/1935 | Gross | 49/104 |
| 2,692,566 | 10/1954 | Mitchell | 135/8 X |
| 3,169,542 | 2/1965 | Neumark | 52/2 |
| 3,370,380 | 2/1968 | Petros | 49/40 |
| 3,577,691 | 5/1971 | Persson | 52/72 |
| 3,660,951 | 5/1972 | Cadwell | 52/2 |
| 3,736,754 | 6/1973 | Azalbert et al. | 52/2 |
| 4,013,018 | 3/1977 | Hansen et al. | 52/2 X |
| 4,167,086 | 9/1979 | Oase | 52/2 |

*Primary Examiner*—J. Karl Bell

*Attorney, Agent, or Firm*—Hill, Van Santen, Steadman, Chiara & Simpson

[57] ABSTRACT

A stadium cover includes a pair of complemental compartmented canopies which are filled with a gas such as helium and which are moored or anchored by two or more winches to enable selective manipulation of their position. The winches act through cable sets that interconnect the winches with the canopies, and pulley means are provided to furnish several points for mooring and moving forces used in the control of the canopies.

8 Claims, 4 Drawing Figures

FIG. 1
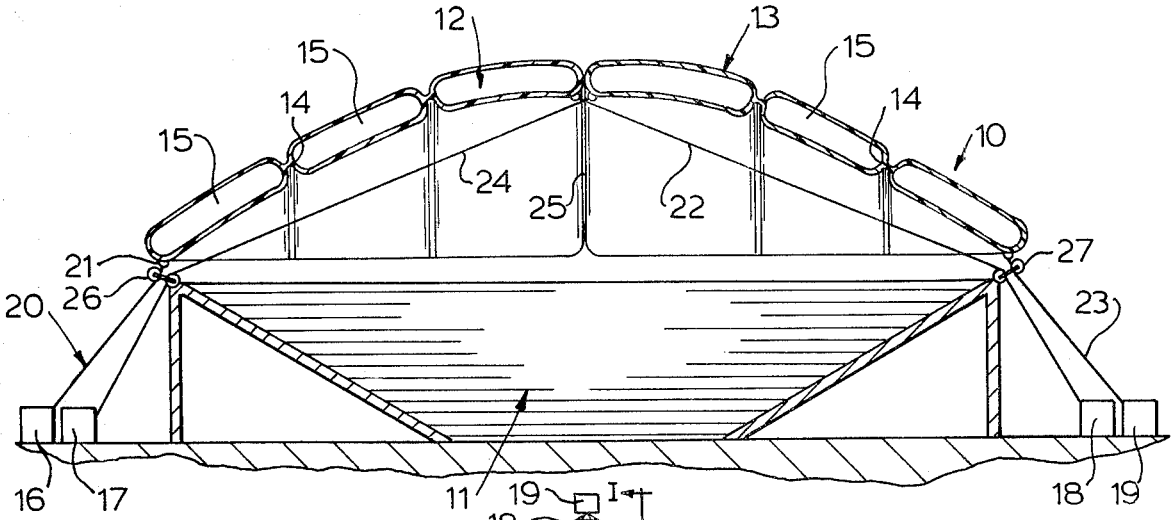
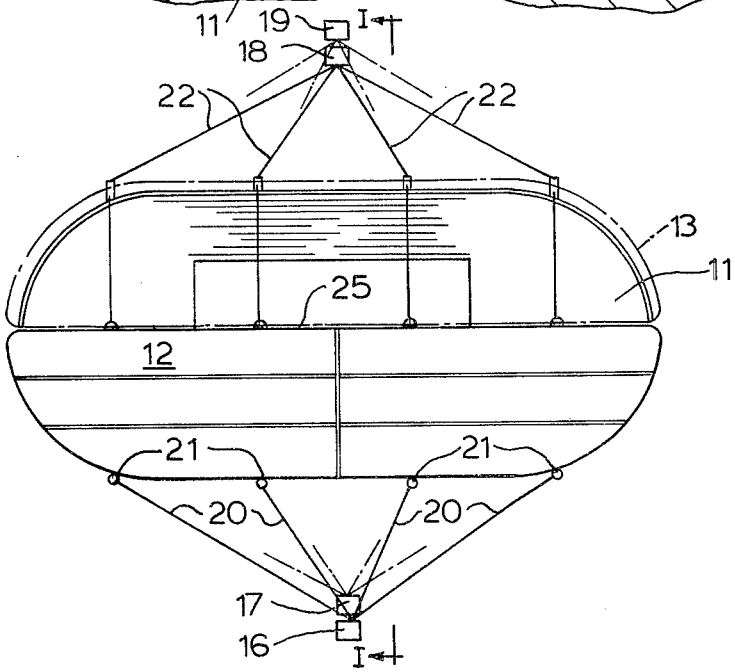
FIG. 2
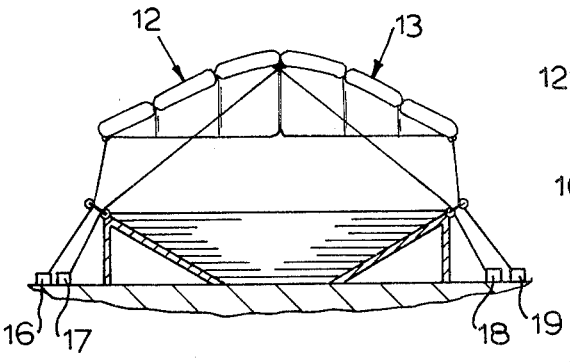
FIG. 4
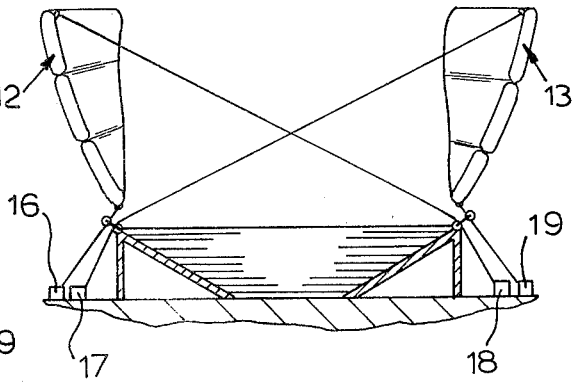
FIG. 3

STADIUM COVER

BACKGROUND OF THE INVENTION

1. Field of the Invention

This invention pertains to a stadium cover, and more particularly to a gas-filled cover that can be opened and closed.

2. Prior Art

It has been known heretofore to cover the playing field of a stadium with a tarpaulin to protect against snow, rain or the like. It has also been known heretofore to provide a permanent dome over a stadium so as to protect the occupants from the elements. A tarpaulin really does nothing for the spectators; and a dome construction is rather costly.

SUMMARY OF THE INVENTION

The present invention comprises a pair of complemental canopies that are filled with a gas such as helium and which can be installed above an existing stadium structure, there being means for anchoring and selectively moving or pivoting the canopies.

Accordingly, it is an object of the present invention to provide an inexpensive gas-supported stadium cover which can be opened and closed.

Many other advantages, features, and additional objects of the present invention will become manifest to those versed in the art upon making reference to the detailed description and the accompanying sheet of drawings in which a preferred structural embodiment incorporating the principles of the present invention is shown by way of illustrative example.

ON THE DRAWINGS

FIG. 1 is a cross-sectional view through a stadium provided with a stadium cover in accordance with the present invention, and taken generally along the line I—I on FIG. 2;

FIG. 2 is a plan view thereof in reduced scale with one canopy removed to simplify illustration;

FIG. 3 corresponds to FIG. 1 in reduced scale showing the canopies open in one mode; and FIG. 4 corresponds to FIG. 1 in reduced scale and showing the canopies open in another mode.

AS SHOWN ON THE DRAWINGS

The principles of the present invention are particularly useful when embodied in a stadium cover as shown in FIG. 1, generally indicated by the numeral 10. The cover 10 is disposed in superimposed relation to a stadium 11 and includes a pair of complemental canopies 12, 13. The canopies preferably comprise sheet material such as plastic or other material that will be inert with respect to a gas used for buoyancy, such as helium. To prevent the cover from inflating like a balloon, numerous webs 14 are provided so that each of the canopies has several compartments 15. The webs 14 may be in the form of heat seals. If desired, more than one type of material may be utilized. For example, some of the compartments may be opaque, some translucent, and some transparent so as to provide a desired degree of capability of transmitting light. If a given compartment 15 does not need to be filled with gas, it can be replaced with a single panel having the desired properties.

In this embodiment, winches, cables and pulleys provide anchoring, reference, and movement. In the disclosed embodiment, there is a set of four winches 16-19 disposed as pairs on opposite sides of the stadium 11. As shown in FIGS. 1 and 2, the winch 16 is connected to a cable set 20 which leads to a number of anchoring points 21 disposed along one edge of the canopy 12. The opposite or central edge of the canopy 12 is connected by a further cable set 22 to the winch 18. In like manner as shown in FIG. 1, the canopy 13 has a cable set 23 connecting one edge thereof to the winch 19 and a cable set 24 connecting the opposite edge thereof to the winch 17. There is a natural tendency for the canopies 12, 13 to rise, and they are anchored in a vertical sense by the cables sets 20, 22–24 to the winches 16–19. The winches have been illustrated as being beyond the perimeter of the stadium for ease of illustration, but in an actual installation would undoubtedly be placed within the stadium, that is beneath the seating area, and provided with additional pulleys and guards for the cables. The present illustration is simpler to understand. Whenever the winches are located, a suitable number of pulleys are utilized and they can be adapted to be supported on the stadium itself or on other columns provided for such purpose. The locations of the pulleys thus provide a reference for the points where each canopy is held or moored. In the event that the winches 16, 19 and the cable sets 20, 23 are permitted to remain in the illustrated position, then they function as a means for pivotally supporting each of the canopies along one edge thereof at opposite sides of the stadium.

As shown in FIG. 3, if cable is payed out by the winches 17 and 18, the canopies will pivot about their outer edges, substantially as shown in FIG. 3. The canopies can be opened in this manner to the extent desired to admit sunshine, light, rain, or whatever may be desired at the time. If the four winches 16–19 are operated to pay out cable at the same effective rate, then the canopies will rise jointly as shown in FIG. 4 to provide ventilation while still providing protection against sun, rain, snow or the like directed from above.

The canopies can have various configurations depending upon the shape of the stadium and the area that is desired to be covered. In this embodiment, the canopies jointly have a hollow generally hemispherical shape, and they have abutting edges that meet in a central vertical plane indicated by the numeral 25. (In FIG. 2, the canopy 13 and its cables are shown in phantom lines.) Further, the generally hemispherical shape can be horizontally elongated along the plane 25. In this embodiment, the canopies 12, 13 have substantially identical configurations or shapes so that two canopies of the same construction can be used jointly. With the pulleys such as those disposed at 26 and 27 in FIG. 1 supported on posts or columns, the stadium cover becomes actually independent of the stadium 11 and can be used as free-standing structure for other purposes such as a form of tent that has no central poles as well as for other types for uses such as a cover for stored material such as grain.

Although various minor modifications might be suggested by those versed in the art, it should be understood that I wish to embody within the scope of the patent warranted hereon all such embodiments as reasonably and properly come within the scope of my contribution to the art.

I claim as my invention:

1. A stadium cover, comprising:

(a) a pair of complemental canopies adapted to jointly overlie the stadium, each canopy having a plurality of compartments adapted to be filled with a lighter-than-air gas;

(b) means for pivotally supporting each of said canopies along one edge thereof at opposite sides of the stadium; and (c) means connected to said canopies, remotely from said one edge of each canopy, for pivoting each said canopy.

2. A stadium cover according to claim 1, said pivoting means including:

(a) a pair of winches for being arranged at opposite sides of the stadium;

(b) a first cable set connecting a first of said winches to a first of said canopies remotely from said one edge thereof, and a second cable set connecting a second of said winches to a second of said canopies remotely from said one edge; and (c) pulley means adapted to be fixedly supported as a reference for guiding said cable sets.

3. A stadium cover according to claim 1, said canopies jointly having a hollow generally hemispherical shape, the canopies meeting in a central vertical plane.

4. A stadium cover according to claim 3, in which the shape is horizontally elongated in said vertical plane.

5. A stadium cover according to claim 1, one of said canopies having the same configuration as the other.

6. A stadium cover, comprising:

(a) a pair of complemental canopies adapted to jointly overlie the stadium, each canopy having a plurality of compartments adapted to be filled with a lighter-than-air gas;

(b) a set of four winches for being arranged in pairs at opposite sides of the stadium;

(c) a cable-set for each winch and respectively connected at one end thereto, the other end of a first cable set being connected to one side of a first of the canopies, the other end of a second cable set being connected to the opposite edge of said first canopy, the winches of said first and second cable sets being on opposite sides of the stadium, the other end of a third cable set being connected to one side of a second of the canopies, the other end of a fourth cable set being connected to the opposite side of said second canopy, and (d) pulley means adapted to be fixedly supported as a reference for guiding said cable sets.

7. A stadium cover according to claim 1, said canopies comprising light-transmitting plastic.

8. A stadium cover according to claim 1, including helium gas inflating said compartments.

* * * * *